US010714877B2

(12) United States Patent
Zhou

(10) Patent No.: US 10,714,877 B2
(45) Date of Patent: Jul. 14, 2020

(54) ELECTRICAL CONNECTOR HAVING TWO TERMINAL MODULE UNITS OF SAME STRUCTURE

(71) Applicants: FUYU ELECTRONICAL TECHNOLOGY (HUAIAN) CO., LTD., Huai'an (CN); FOXCONN INTERCONNECT TECHNOLOGY LIMITED, Grand Cayman (KY)

(72) Inventor: Shao-Cong Zhou, Huaian (CN)

(73) Assignees: FUYU ELECTRONICAL TECHNOLOGY (HUAIAN) CO., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 32 days.

(21) Appl. No.: 16/231,372

(22) Filed: Dec. 21, 2018

(65) Prior Publication Data

US 2019/0199038 A1 Jun. 27, 2019

(30) Foreign Application Priority Data

Dec. 25, 2017 (CN) ..... 2017 2 1842189 U

(51) Int. Cl.

| | |
|---|---|
| ***H01R 13/6585*** | (2011.01) |
| ***H01R 13/504*** | (2006.01) |
| ***H01R 13/405*** | (2006.01) |
| ***H01R 13/6587*** | (2011.01) |
| *H01R 107/00* | (2006.01) |
| *H01R 12/71* | (2011.01) |
| *H01R 24/60* | (2011.01) |
| *H01R 43/24* | (2006.01) |

(52) U.S. Cl.

CPC ..... *H01R 13/6585* (2013.01); *H01R 13/405* (2013.01); *H01R 13/504* (2013.01); *H01R 13/6587* (2013.01); *H01R 12/716* (2013.01); *H01R 24/60* (2013.01); *H01R 43/24* (2013.01); *H01R 2107/00* (2013.01)

(58) Field of Classification Search

CPC ..... H01R 13/6585

See application file for complete search history.

(56) References Cited

U.S. PATENT DOCUMENTS

| | | | | |
|---|---|---|---|---|
| 7,232,344 | B1 | 6/2007 | Gillespie et al. | |
| 2015/0229077 | A1 | 8/2015 | Little et al. | |
| 2017/0222342 | A1* | 8/2017 | Ho | H01R 24/62 |
| 2017/0256881 | A1 | 9/2017 | Lambie et al. | |
| 2018/0138627 | A1* | 5/2018 | Zhou | H01R 13/6275 |
| 2018/0151992 | A1* | 5/2018 | Zhao | H01R 13/6586 |
| 2018/0212338 | A1* | 7/2018 | Chang | H01R 13/6586 |
| 2018/0337486 | A1* | 11/2018 | Zhao | H01R 12/724 |
| 2019/0067860 | A1* | 2/2019 | Zhao | H01R 13/405 |
| 2019/0131745 | A1* | 5/2019 | Zhao | H01R 13/6585 |

(Continued)

*Primary Examiner* — James Harvey

(74) *Attorney, Agent, or Firm* — Wei Te Chung; Ming Chieh Chang

(57) ABSTRACT

An electrical connector includes: a terminal module including a first unit, a second unit, and a shielding plate between the first and second units, each of the first unit and the second unit having an insulative body and a row of contacts, the insulative body including a rear base and a front tongue; and a shielding shell enclosing the terminal module, wherein the first unit and the second unit have same structure.

15 Claims, 9 Drawing Sheets

(56) References Cited

U.S. PATENT DOCUMENTS

| | | | | |
|---|---|---|---|---|
| 2019/0148888 | A1* | 5/2019 | Huang | H01R 13/5025<br>439/607.05 |
| 2019/0199038 | A1* | 6/2019 | Zhou | H01R 13/6587 |
| 2019/0229459 | A1* | 7/2019 | Zhou | H01R 12/7023 |

* cited by examiner

ELECTRICAL CONNECTOR HAVING TWO TERMINAL MODULE UNITS OF SAME STRUCTURE

BACKGROUND OF THE INVENTION

1. Field of the Invention

The present invention relates to an electrical connector of a vertical or straight type, in contrast to a right angle type, including a terminal module having a first unit, a second unit, and a shielding plate between the first and second units, wherein the first unit and the second unit have same structure.

2. Description of Related Art

U.S. Patent Application Publication No. 2015/0229077 depicts a vertical receptacle connector for mounting to a printed circuit board in an upstanding manner.

U.S. Patent Application Publication No. 2017/0256881 discloses a USB type connector that may be a vertical/straight version connector or a right angle version connector. In the vertical embodiment, contact tails extend straight out of a rear of the connector. As a result, a printed circuit board to which the connector is mounted is parallel to a panel that the connector is associated.

SUMMARY OF THE INVENTION

An electrical connector comprises: a terminal module including a first unit, a second unit, and a shielding plate between the first and second units, each of the first unit and the second unit having an insulative body and a row of contacts, the insulative body including a rear base and a front tongue; and a shielding shell enclosing the terminal module, wherein the first unit and the second unit have same structure.

DETAILED DESCRIPTION OF THE PREFERRED EMBODIMENT

Figure 1:
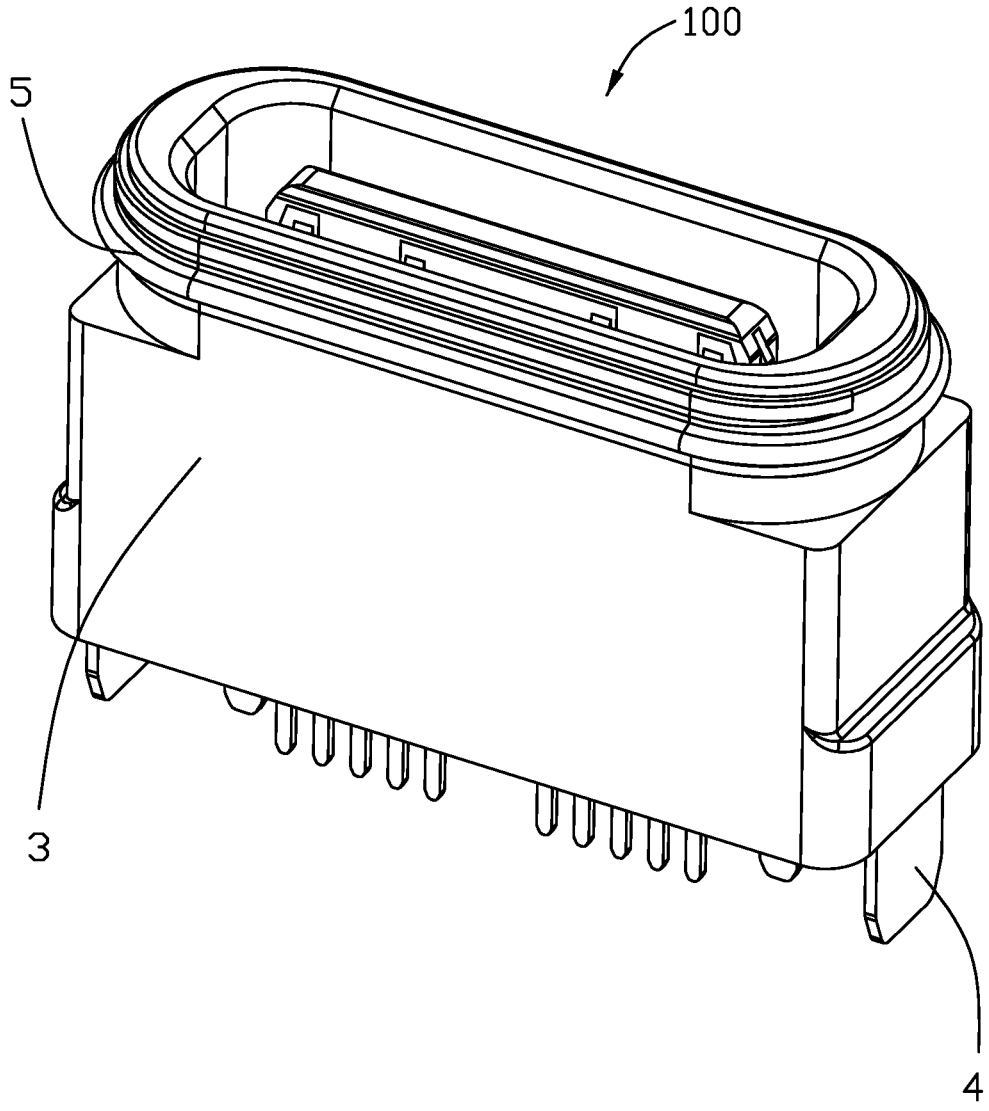
FIG. 1 is a perspective view of an electrical connector in accordance with the present invention.
Figure 2:
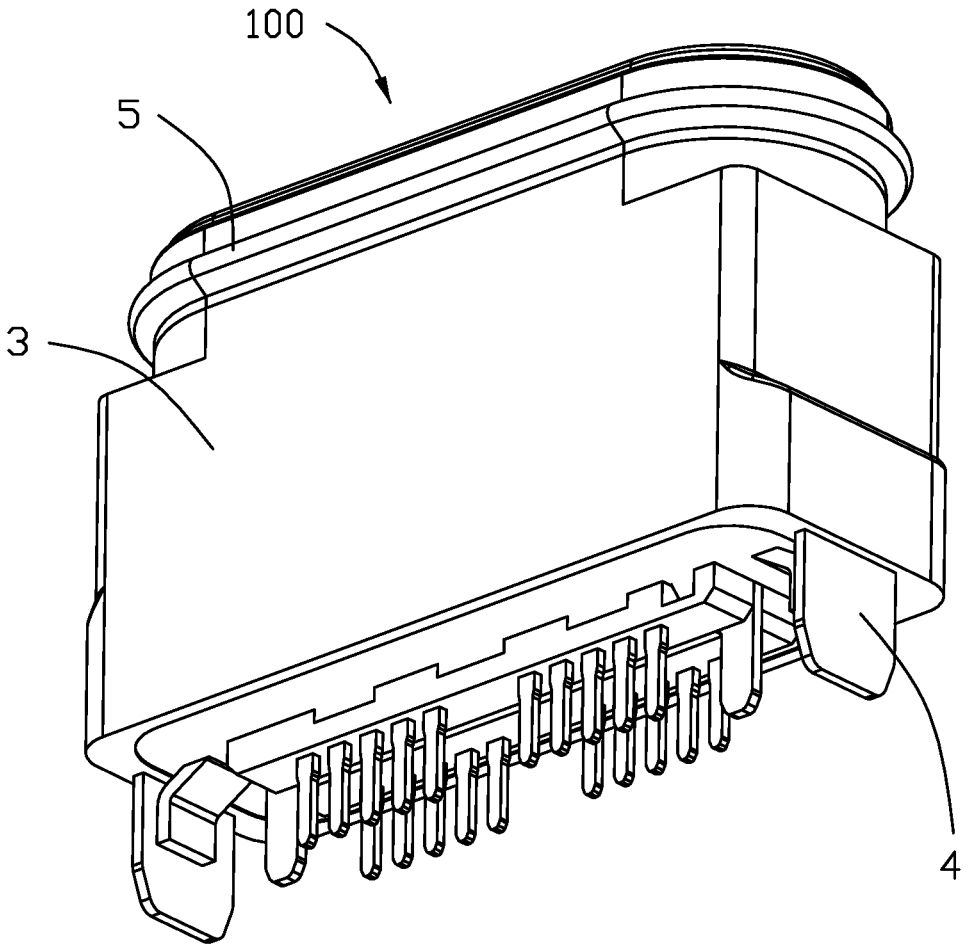
FIG. 2 is another perspective view of the electrical connector.

Referring to FIGS. 1-9, an electrical connector 100 includes a terminal module 1 and a shielding shell 2 enclosing the terminal module 1. The shielding shell 2 may be integrated to an insulative cover 3 with a pair of stands 4. The electrical connector 100 may further include a front sealing member 5 and a rear sealing member 6.

Referring to FIGS. 3-9, the terminal module 1 includes a first unit 11, a second unit 12, a shielding plate 13 between the first unit 11 and the second unit 12, and an over-molding insulator 14 molded to the first unit 11, the second unit 12, and the shielding plate 13. The first unit 11 has a first insulative body 111 and a first row of contacts 112 secured to (e.g., insert molded with) the insulative body 111. The second unit 12 has a second insulative body 121 and a second row of contacts 122 secured to (e.g., insert molded with) the insulative body 121.

Referring to FIGS. 3-8, the insulative body 111 and the insulative body 121 have same structure. The insulative body 111 and the insulative body 121 have respective mounting surfaces 1111 and 1211 facing each other. Each insulative body 111 or 121 has a rear base 113, a front tongue 114, and an intermediate step 115. The step 115 has a groove 1151. The base 113 has a hook 1131 and a hole 1132 on the mounting surface side.

The first row of contacts 112 and the second row of contacts 122 are equal in number and reversely-symmetrically arranged to support dual orientation mating, as is well known in this art.

The first row of contacts 112 and the second row of contacts 122 have same structure. Each contact includes a securing potion 1121, a contacting portion 1122, and a soldering portion 1123. Each row of contacts include a pair of outermost ground contacts 1124. One of the pair of outermost ground contacts 1124 has a bent portion 1125.

The shielding plate 13 has a main portion 131, a pair of front portions 132, and a pair of soldering legs 133. The main portion 131 has a pair of holes 1311.

Since the insulative body 111 and the insulative body 121 have same structure and the first row of contacts 112 and the second row of contacts 122 have same structure, only one same set of molds is needed for manufacturing the first unit 11 and the second unit 12 which are of same structure.

The shielding plate 13 is clamped between the first unit 11 and the second unit 12 through the hook 1131 and hole 1132 structure and cooperating holes 1311 feature. Also the bent portion 1125 of the ground contact 1124 of one unit is received in the groove 1151 of the other unit. With securement of the first unit 11, the second unit 12, and the shielding plate 13, the over-molding insulator 14 is then molded.

Figure 3:
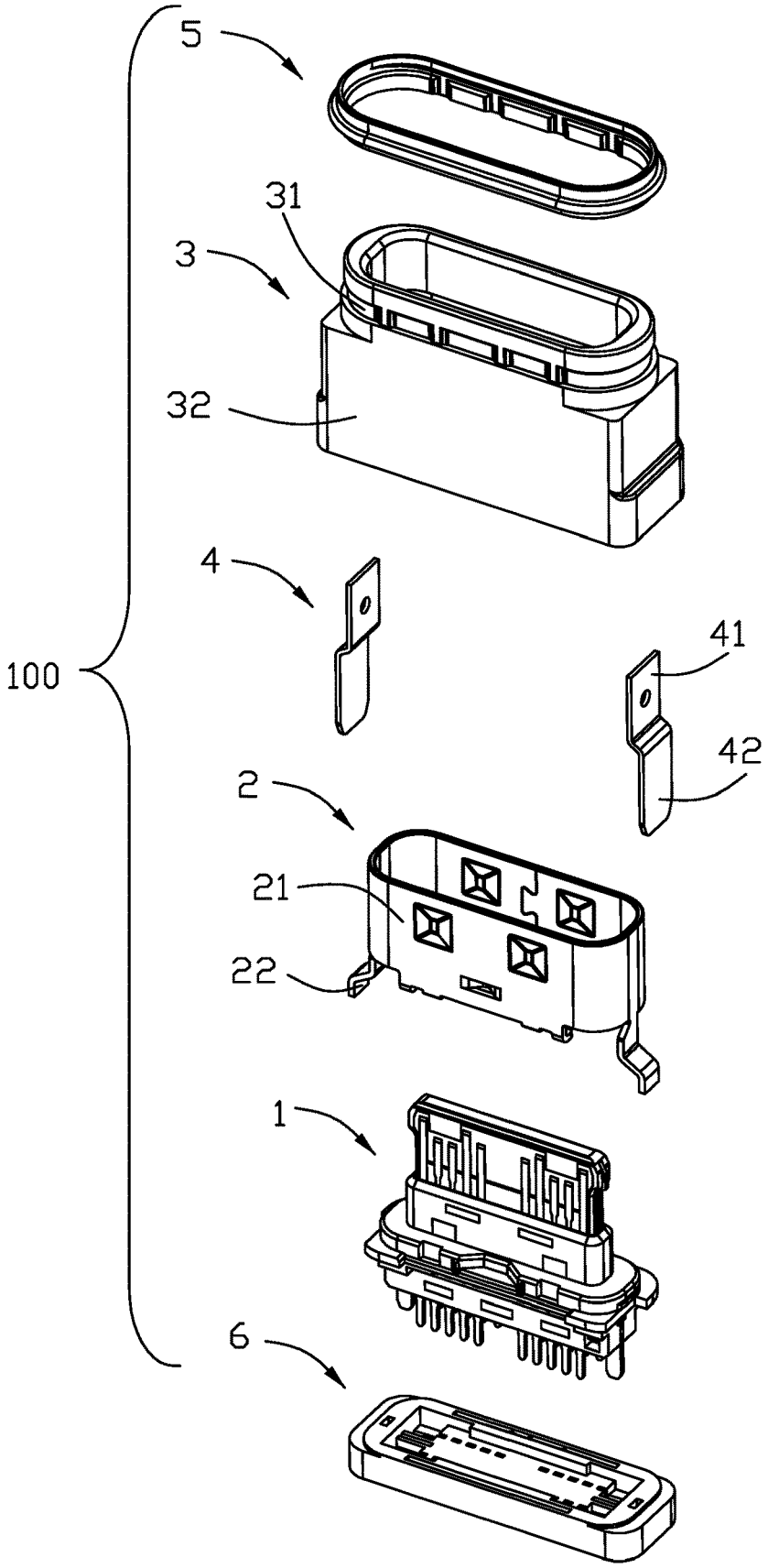
FIG. 3 is an exploded view of the electrical connector.
Figure 4:
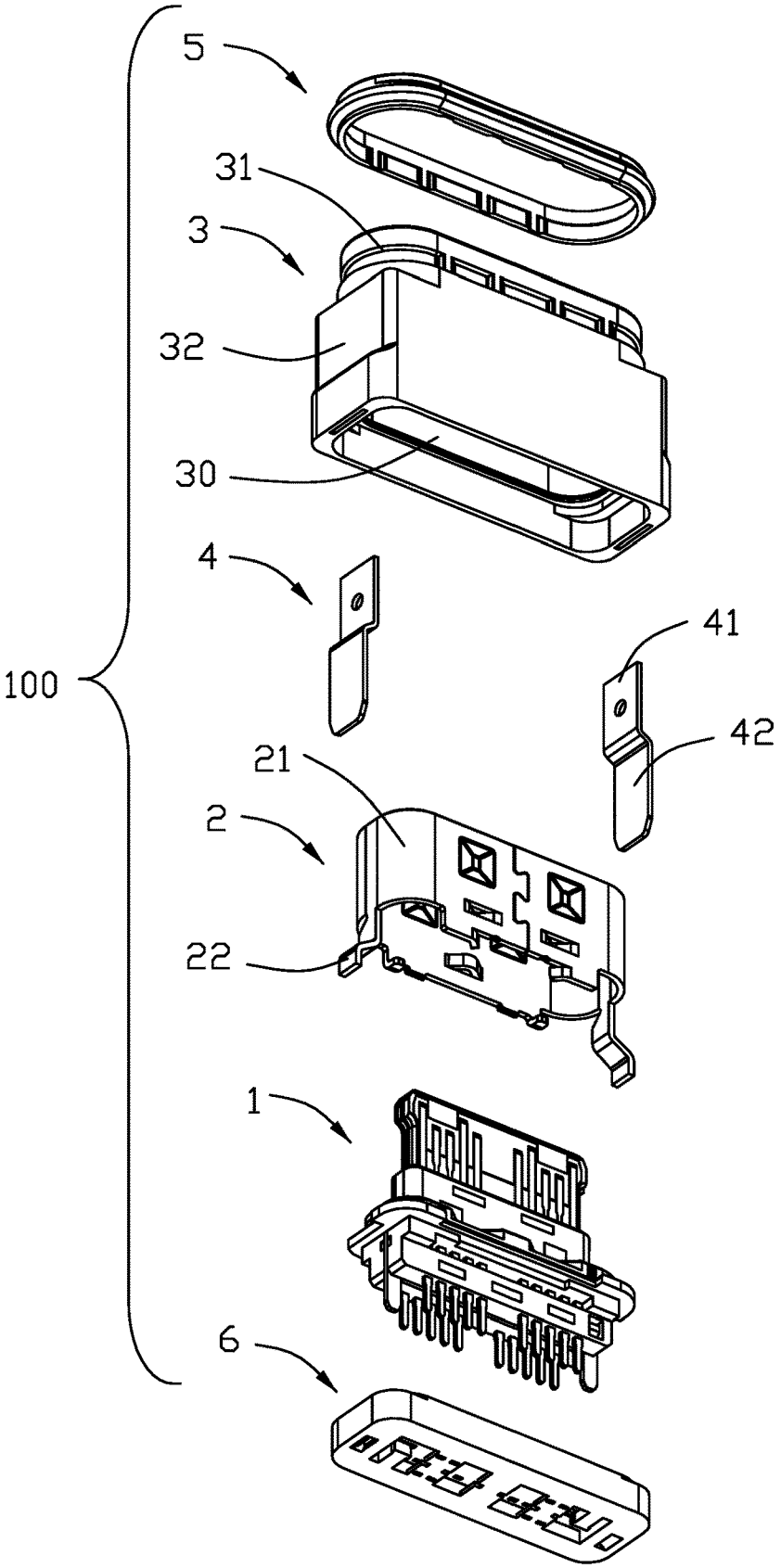
FIG. 4 is another exploded view of the electrical connector.
Figure 5:
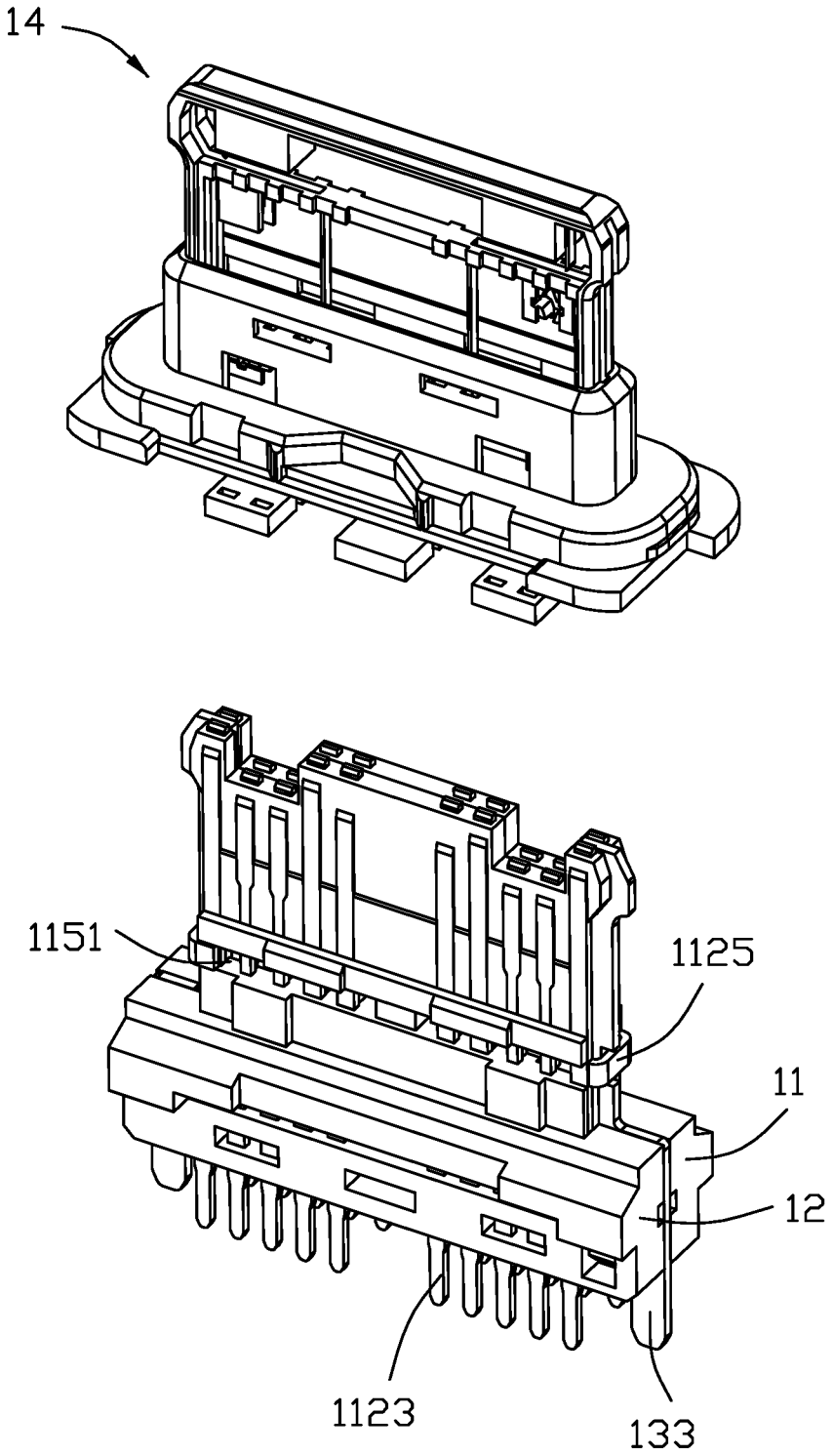
FIG. 5 is an exploded view of a terminal module of the electrical connector.
Figure 6:
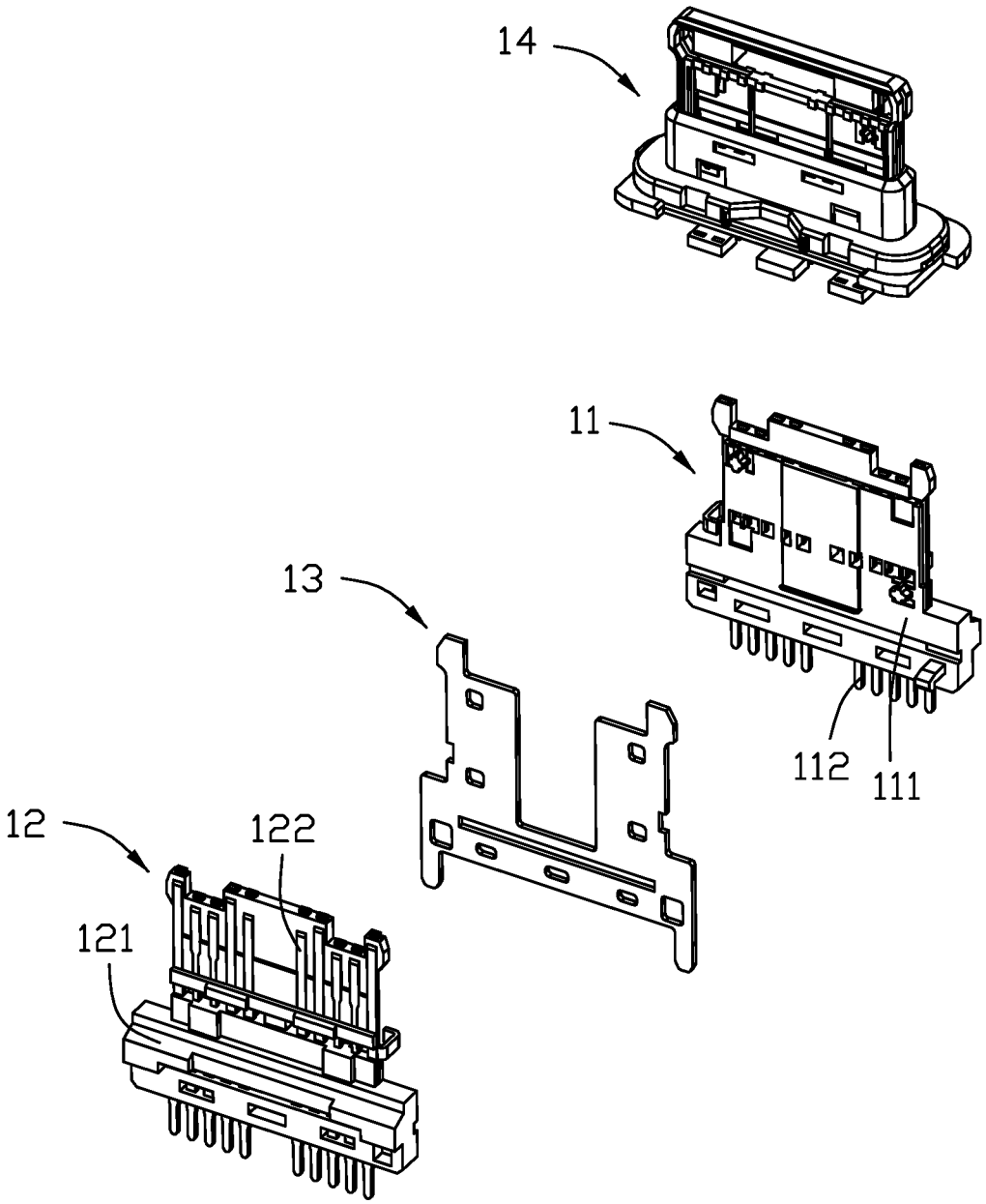
FIG. 6 is a further exploded view of the terminal module.
Figure 7:
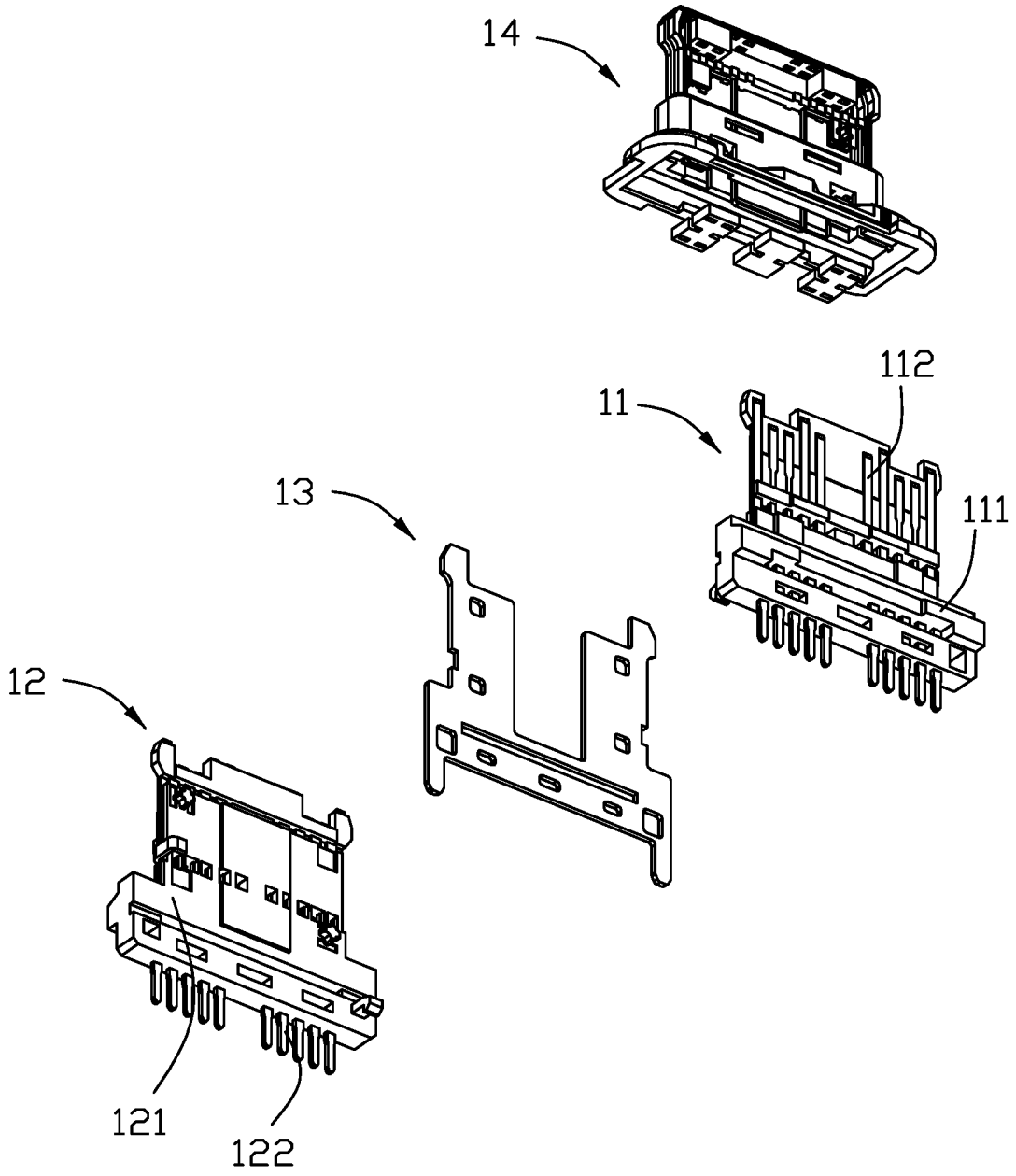
FIG. 7 is a view similar to FIG. 6 but from another perspective.
Figure 8:
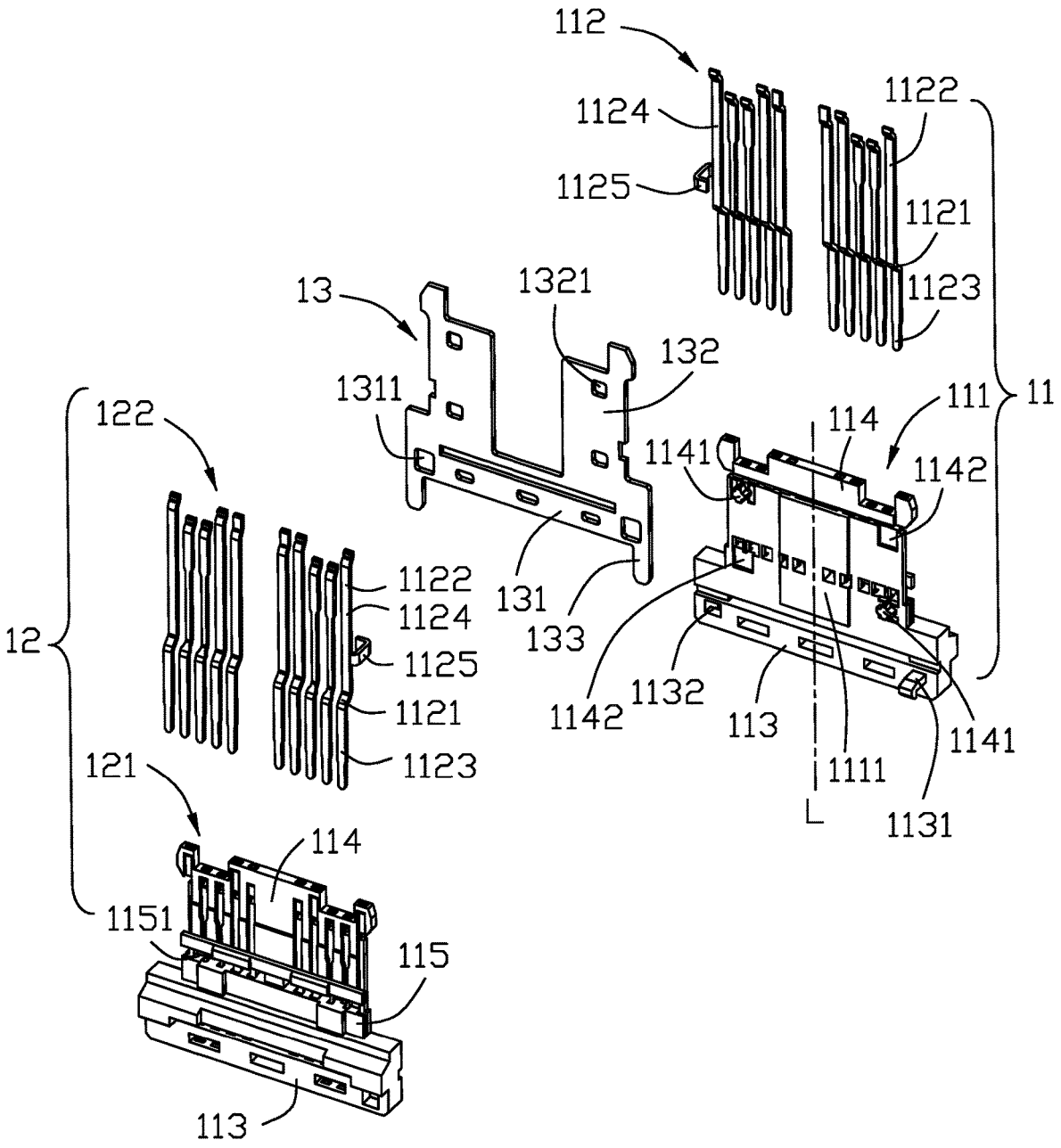
FIG. 8 is a further exploded view of the terminal module in FIG. 6.
Figure 9:
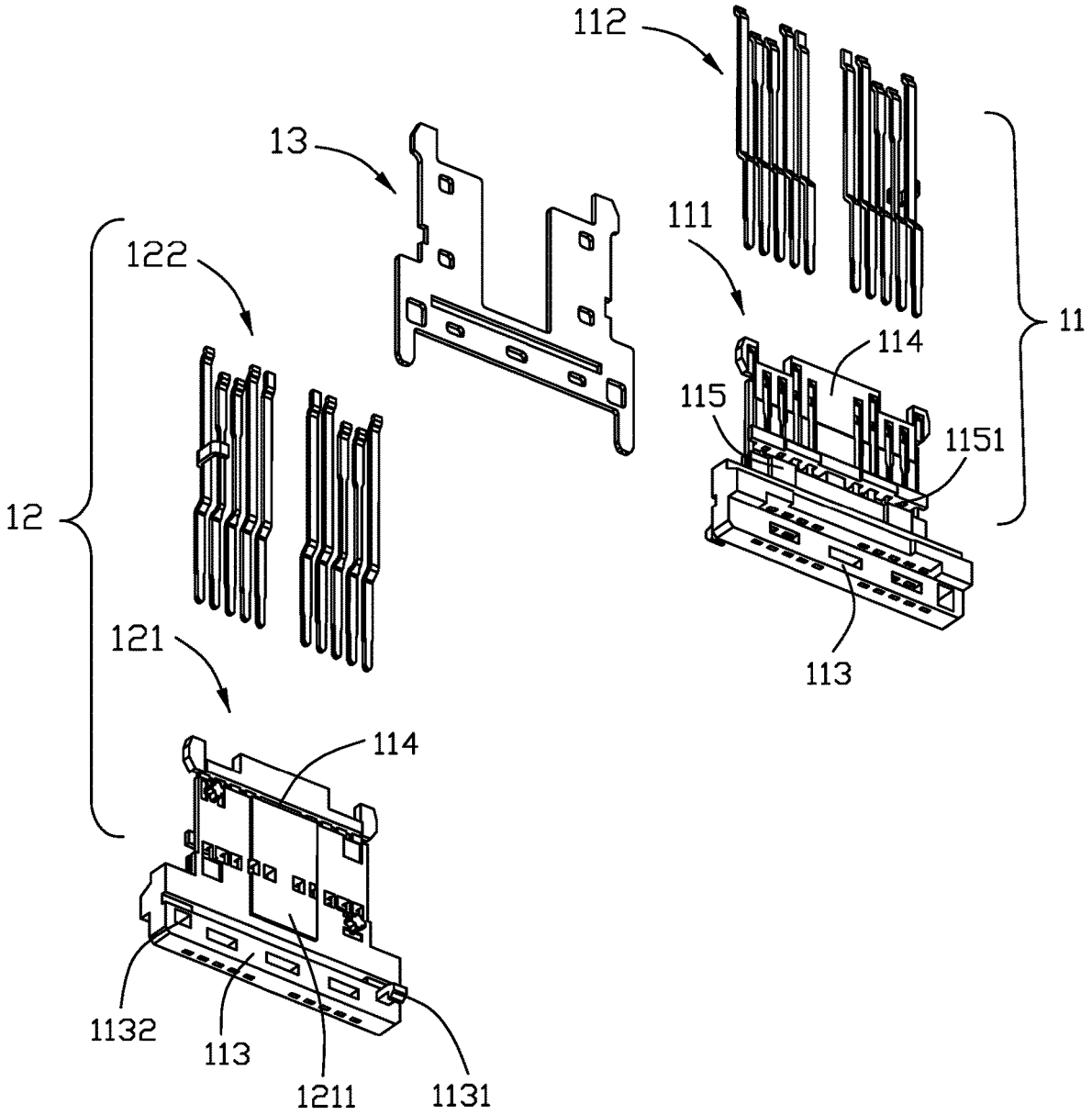
FIG. 9 is a view similar to FIG. 8 but from another perspective.

Referring to FIGS. 3-4, the shielding shell 2 has a main body and a pair of side arms 22. The side arms 22 are located beside the bases 113.

The insulative cover 3 has an annular part 31 and a frame part 32 together defining a receiving chamber 30.

The pair of stands 4 are secured to the insulative cover 3. Each stand 4 has an embedded portion 41 and a fixing arm 42. The front sealing member 5 is disposed in the annular part 31. The insulative cover 3 together with the stands 4 and the sealing member 5 is disposed onto the shielding shell 2 which encloses the terminal module 1, with the side arm 22 bearing against the fixing arm 42.

The rear sealing member 6 is applied behind the bases 113 of the terminal module 1 and at an interface between the module 1 and the cover 3. The soldering portions 1123 of the contacts, the soldering legs 133 of the shielding plate 13, and the fixing arms 42 of the stands 4 extend outwardly beyond the rear sealing member 6 for reliably soldering to a printed circuit board. On one hand, one feature of the connector is to have each first/second unit 11/12 structurally asymmetrically arranged with regard to the corresponding centerline L extending along the front-to-back direction, and centerline L is also the centerline of the whole connector viewed in the vertical direction. For example, in each first/second unit 11/12 there is a bent portion 1125 on one lateral side while lacking on the other lateral sides. Also, the hook 1131 on one lateral side and the hole 1132 in the other lateral side, along the transverse direction, are arranged with each other in a symmetrical manner with regard to the vertical centerline L. Similarly, the pair of retaining posts 1141 of each first/second unit 11/12 should be respectively symmetrically arranged with the corresponding through holes 1142 relative to the front-to-back centerline L while such pair of retaining posts 1141 should be offset from each other in the front-to-back direction as well as the pair of holes 1142. As a result, the first unit 11 and the second unit 12 are reversely symmetrically arranged with each other in the vertical direction when viewed along the front-to-back direction. On the other hand, the single shielding plate 13 itself is symmetrically arranged with regard to the centerline. Notably, the shielding plate 13 further forms a plurality of through holes 1321 to receive the corresponding retaining posts 1141, respectively. Understandably, the shielding plate 13 may be divided into two pieces along the front-to-back centerline or a middle portion thereof is removed to have only two lateral side portions left under consideration of some mechanical and electrical issues. Notably, even though in this embodiment, the connector is configured/adapted to be vertically positioned upon a printed circuit board which is normally horizontally positioned, the direction description about the parts of the whole connector still refers to the regularly horizontally oriented connector. Different from both the shielding plate 13 and the first/second unit 11/12, the shielding shell 2 is structured not to be symmetrical or reversely symmetrical with regard to the front-to-back centerline.

What is claimed is:

1. An electrical connector comprising:

a terminal module including a first unit, a second unit, and a shielding plate between the first and second units, each of the first unit and the second unit having an insulative body and a row of contacts, the insulative body including a rear base and a front tongue; and a shielding shell enclosing the terminal module; wherein the first unit and the second unit have same structure;

wherein the terminal module includes an over-molding insulator molded to the first unit, the second unit, and the shielding plate.

2. The electrical connector as claimed in claim 1, wherein each of the first unit and the second unit includes a respective outermost contact, and the outermost contact of the first unit engages the insulative body of the second unit and the outermost contact of the second unit engages the insulative body of the first unit.

3. The electrical connector as claimed in claim 1, wherein each of the rear base of the first unit and the rear base of the second unit includes a hook and a hole, and the hook of the first unit engages the hole of the second unit and the hook of the second unit engages the hole of the first unit.

4. A method of making an electrical connector comprising steps of:

providing a pair of units each with a plurality of contacts integrally formed within an insulative body via an insert-molding process wherein said pair of units are same with each other;

providing a metallic shielding plate; and assembling the pair of units in a back-to-back manner with the shielding plate therebetween in a vertical direction; wherein in a transverse direction perpendicular to the vertical direction, each of the pair of units has a first securing device on one lateral side and a second securing device on the other lateral side symmetrically arranged with each other with regard to a front-to-back centerline extending along a front-to-back direction perpendicular to both the vertical direction and the transverse direction, so as to have the first securing device of one of the pair of units engages the second securing device of the other of the pair of units, and the second securing device of said one of the pair of units engages the first securing device of the other of the pair of units; wherein said first securing device is different from said second securing device.

5. An electrical connector comprising:

a contact module including a first unit and a second unit back to back assembled with each other with a metallic shielding plate sandwiched therebetween in a vertical direction, each of the first unit and the second unit includes a plurality of contacts integrally retained in an insulative body, wherein the first unit and the second unit are same with each other, and each of the first unit and the second unit is asymmetrically arranged with regard to a front-to-back centerline thereof extending along a front-to-back direction perpendicular to the vertical direction so as to have said first unit and said second unit reversely symmetrically arranged with each other in said vertical direction when viewed along the front-to-back direction;

wherein each of the first unit and a second unit has a pair of retaining posts respectively on two lateral sides in a transverse direction perpendicular to both the vertical direction and the front-to-back direction in a an offset manner along the front-to-back direction.

6. The electrical connector as claimed in claim 5, wherein each of the first unit and the second unit has a hook and a hole symmetrically located at opposite lateral sides thereof in a transverse direction perpendicular to both the vertical direction and the front-to-back direction.

7. The method as claimed in claim 4, wherein in each of said pair of units, one of two opposite outermost contacts of said contacts has a bent portion while the other of said two opposite outermost contacts of said contacts has no bent portion.

8. The electrical connector as claimed in claim 5, wherein the metallic shielding plate is symmetrically arranged with regard to the front-to-back centerline.

9. The electrical connector as claimed in claim 8, wherein said shielding plate includes a plurality of through holes symmetrically arranged with regard to the front-to-back centerline.

10. The electrical connector as claimed in claim 5, wherein in each of the first unit and the second unit, both the contacts and the insulative body are asymmetrical with regard to the front-to-back centerline.

11. The electrical connector as claimed in claim 5, further including a metallic shielding shell enclosing the contact module, wherein said shielding shell is not symmetrical with regard to the front-to-back centerline, either normally or reversely.

12. The electrical connector as claimed in claim 5, wherein in each of said first unit and said second unit, one of two opposite outermost contacts of said contacts has a bent portion while the other of said two opposite outermost contacts of said contacts has no bent portion.

13. The method as claimed in claim 4, wherein each of said pair of units is not symmetrical with regard to the front-to-back centerline while said pair of units are reversely symmetrical with each other relative to the front-to-back centerline in the vertical direction when view along the front-to-back direction.

14. The method as claimed in claim 13, wherein the shielding plate is symmetrical with regard to the front-to-back centerline.

15. The method as claimed in claim 14, wherein said first securing device is a hook and said second securing device is a hole receiving said hook.

* * * * *